United States Patent [19]

Shellenberger

[11] Patent Number: 5,042,453

[45] **Date of Patent: * Aug. 27, 1991**

[54] COMPACT, HIGH EFFICIENCY HEAT EXCHANGER FOR A FUEL-FIRED FORCED AIR HEATING FURNACE

[75] Inventor: Timothy J. Shellenberger, Fort Smith, Ark.

[73] Assignee: Rheem Manufacturing Company, New York, N.Y.

[ * ] Notice: The portion of the term of this patent subsequent to Dec. 4, 2007 has been disclaimed.

[21] Appl. No.: 559,624

[22] Filed: Jul. 27, 1990

Related U.S. Application Data

[63] Continuation-in-part of Ser. No. 415,121, Sep. 28, 1989, Pat. No. 4,974,579.

[51] Int. Cl.[5] ..... F24H 3/02

[52] U.S. Cl. ..... 126/110 R; 126/116 R

[58] Field of Search ..... 126/110 R, 99 A, 116 R; 165/144, 145

[56] References Cited

U.S. PATENT DOCUMENTS

| | | | |
|---|---|---|---|
| 601,590 | 3/1898 | Rossman . | |
| 2,353,606 | 7/1944 | Watts | 126/104 |
| 2,499,358 | 3/1950 | Cooper et al. | 257/2 |
| 2,521,866 | 9/1950 | Ott | 126/110 |
| 2,525,400 | 10/1950 | Crawford | 126/110 |
| 2,527,937 | 10/1950 | Klug | 126/110 |
| 2,589,553 | 3/1952 | King et al. | 126/110 |
| 2,769,619 | 11/1956 | Juhasz | 257/6 |
| 2,808,047 | 10/1957 | Jaye et al. | 126/116 |
| 3,189,017 | 6/1965 | Hahn | 126/116 |
| 3,194,214 | 7/1965 | Frendberg | 122/1 |
| 3,311,155 | 3/1967 | Hershey et al. | 158/7 |
| 3,358,672 | 12/1967 | Dirk et al. | 126/110 |
| 3,667,451 | 6/1972 | Boucher | 126/110 R |
| 3,922,768 | 12/1975 | Takayasu | 29/157.3 R |
| 3,930,489 | 1/1976 | Anable | 126/99 R |
| 4,044,443 | 8/1977 | Chartet | 29/157.4 |
| 4,308,990 | 1/1982 | Borovina et al. | 236/10 |
| 4,465,129 | 8/1984 | Baldensperger et al. | 165/153 |
| 4,467,780 | 8/1984 | Ripka | 126/110 R |
| 4,478,206 | 10/1984 | Ahn | 126/99 A |
| 4,485,867 | 12/1984 | Melnyk et al. | 165/173 |
| 4,505,017 | 3/1985 | Schukei | 29/157.3 R |
| 4,533,315 | 8/1985 | Nelson | 431/20 |
| 4,557,249 | 12/1985 | Sweedyk | 126/110 R |
| 4,561,421 | 12/1985 | Hwang et al. | 126/110 R |
| 4,576,226 | 3/1986 | Lipets et al. | 165/134.1 |
| 4,603,681 | 8/1986 | Clawson | 126/110 R |
| 4,718,401 | 1/1988 | DeLancey | 126/110 R |
| 4,718,484 | 1/1988 | Hoeffken | 165/170 |
| 4,730,600 | 3/1988 | Harrigill | 126/108 |
| 4,807,588 | 2/1989 | Bentley et al. | 126/110 R |

*Primary Examiner*—Carroll B. Dority

*Attorney, Agent, or Firm*—Johnson & Gibbs

[57] ABSTRACT

A compact, high efficiency heat exchanger for a fuel-fired forced air furnace has horizontally spaced apart inlet and outlet manifold structures which are innerconnected by a horizontally spaced series of vertically serpentined, relatively small diameter flow transfer tubes. Larger diameter inlet flow tubes are positioned beneath the balance of the heat exchanger, extend parallel to the transfer tubes, and have upturned discharge ends connected to the underside of the inlet manifold. The heat exchanger is configured so that its total vertically facing peripheral surface area is considerably larger than its total horizontally facing peripheral surface area, thereby signficantly reducing undesirable outward heat loss through the vertically extending furnace housing side walls upon burner shut off and increasing the overall efficiency rating of the furnace. To reduce the manufacturing cost of the heat exchanger its components are assembled using a weldless fabrication process which includes swedging the tubes to the manifolds and forming each manifold from two sections which are edge rolled and crimped together.

9 Claims, 1 Drawing Sheet

COMPACT, HIGH EFFICIENCY HEAT EXCHANGER FOR A FUEL-FIRED FORCED AIR HEATING FURNACE

CROSS-REFERENCE TO RELATED APPLICATION

This application is a continuation-in-part of copending U.S. application Ser. No. 415,121 filed on Sept. 28, 1989 and now U.S. Pat. No. 4,794,579, such copending application being hereby incorporated herein by reference.

BACKGROUND OF THE INVENTION

The present invention relates generally to heat exchangers for fuel-fired, forced air heating furnaces, and more particularly relates to compact, high efficiency heat exchangers for such furnaces, and associated fabrication techniques for constructing the heat exchangers.

The National Appliance Energy Conservation Act of 1987 requires that all forced air furnaces manufactured after Jan. 1, 1992, and having heating capacities between 45,000 Btuh and 400,000 Btuh, must have a minimum heating efficiency of 78% based upon Department of Energy test procedures. For two primary reasons, each relating to conventional heat exchanger design, the majority of furnaces currently being manufactured do not meet this 78% minimum efficiency requirement.

First, until recently, most furnace efficiencies were rated based upon "indoor ratings", meaning that the heat losses through the furnace housing walls to the surrounding space were ignored, the implicit assumption being that the furnace was installed in an area within the conditioned space (such as a furnace closet or the like) so that the heat transferred outwardly through the furnace housing ultimately functioned to heat the conditioned space. Under the new efficiency rating scheme, however, furnace efficiencies will be penalized for heat transferred outwardly through the furnace housing to the surrounding space on the assumption that the furnace will be installed in an unheated area, such as an attic, even if the furnace will ultimately be installed within the conditioned space.

Gas-fired residential furnaces are typically provided with "clamshell" type heat exchangers through which the burner combustion products are flowed, and exteriorly across which the furnace supply air is forced on its way to the conditioned space served by the furnace. The conventional clamshell heat exchanger is positioned within the furnace housing and is normally constructed from two relatively large metal stampings edge-welded together to form the heat exchanger body through which the burner combustion products are flowed. In the typical upflow furnace, the clamshell heat exchanger body has a large expanse of vertically disposed side surface area which extends parallel to adjacent vertical side wall portions of the furnace housing. In a similar fashion, in horizontal flow furnaces the clamshell heat exchanger body has a large expanse of horizontally disposed side surface area which extends parallel to the adjacent horizontally extending side wall portion of the furnace housing.

Due to the large surface area of clamshell heat exchangers, and its orientation within the furnace housing, there is a correspondingly large (and undesirable) outward heat transfer from the heat exchanger through the furnace housing which represents a loss of available heat when the furnace is installed in an unheated space.

This potential heat transfer from the heat exchanger through the furnace housing side walls to the adjacent space correspondingly diminishes the efficiency rating of the particular furnace, under the new efficiency rating formula, even when the furnace is not installed in an unheated space.

The second heat exchanger-related factor which undesirably reduces the overall heating efficiency rating of a furnace of this general type arises from the fact the the typical clamshell heat exchanger has a relatively low internal pressure drop. Accordingly, during an "off cycle" of the furnace, this "loose" heat exchanger design permits residual heat in the heat exchanger to rather rapidly escape through the exhaust vent system (due to the natural buoyancy of the hot combustion gas within the heat exchanger) instead of being more efficiently transferred to the heating supply air which continues to be forced across the heat exchanger for short periods after burner shutoff. Stated in another manner, in the typical clamshell type heat exchanger the retention time therein for combustion products after burner shut off is quite low, thereby significantly reducing the combustion product heat which could be usefully transferred to the continuing supply air flow being forced externally across the heat exchanger.

In addition to these heating efficiency problems, conventional clamshell type heat exchangers have a long "dwell period" (upon cold start up) during which condensation is formed on their interior surfaces and remains until the hot burner combustion products flowed internally through the heat exchanger evaporates such condensation. This dwell period, of course, is repeated each time the furnace is cycled. Because of these lengthy dwell periods (resulting from the large metal mass of the clamshell heat exchanger which must be re-heated each time the burners are energized), internal corrosion in clamshell heat exchangers tends to be undesirably accelerated.

These and other problems, limitations and disadvantages commonly associated with clamshell heat exchangers have been substantially lessened by the compact, high efficiency configurational design incorporated in the heat exchanger illustrated and described in my copending U.S. application Ser. No. 415,121 now U.S. Pat. No. 4,974,579. Briefly, that heat exchanger comprises horizontally spaced apart inlet and outlet manifolds interconnected by horizontally spaced apart, vertically serpentined, relatively small diameter flow transfer tubes. A plurality of larger diameter primary inlet tubes extend horizontally beneath the manifolds and have upturned discharge end portions connected to the underside of the inlet manifold.

With the heat exchanger operatively installed in an upflow furnace, the inlet of a draft inducer fan is connected to the outlet manifold and burner flames are flowed into the open inlet ends of the primary inlet tubes. Operation of the draft inducer fan draws hot burner combustion products sequentially through the primary inlet tubes, the inlet manifold, the serpentined flow transfer tubes, and the outlet manifold for discharge by the fan to a suitable vent stack.

As originally envisioned, the compact heat exchanger illustrated and described in U.S. application Ser. No. 415,121, now U.S. Pat. No. 4,974,579, was to be fabricated utilizing a generally conventional welding process to join the sections of each of its manifolds, and to secure the primary inlet tubes and the flow transfer tubes to the manifolds. In subsequent further development of the heat exchanger, however, it has become desirable to even further reduce its overall construction cost by essentially eliminating the need to form weld joints therein. It is accordingly an object of the present invention to provide a compact furnace heat exchanger which is similar in configuration and operation to the heat exchanger just described, but which is assembled essentially without using a welding process to join or form its components.

SUMMARY OF THE INVENTION

The present invention provides a compact, high efficiency heat exchanger which may be operatively positioned in the supply plenum housing portion of an induced draft, fuel-fired forced air heating furnace and is operative to reduce heat outflow from the heat exchanger through the housing side walls, and thereby increase the overall heating efficiency rating of the furnace. When operatively disposed within the supply air plenum of the furnace, the heat exchanger has a first total peripheral surface area facing parallel to the direction of blower-produced air flow through the supply air plenum and externally across the heat exchanger, and a second total peripheral surface area which outwardly faces a side wall section of the housing in a direction transverse to the air flow across the heat exchanger.

Importantly, the first peripheral surface area of the heat exchanger is substantially greater than its second peripheral surface area. Accordingly, the radiant heat emanating from the heat exchanger toward the housing side wall section is substantially less than its radiant heat directed parallel to the air flow. In this manner, the available heat from the heat exchanger is more efficiently apportioned to the supply air, thereby reducing outward heat loss through the furnace housing.

In a preferred embodiment thereof, the heat exchanger of the present invention is generally similar in configuration to the compact heat exchanger illustrated and described in my copending U.S. application Ser. No. 415,121, and includes: an inlet manifold; an outlet manifold spaced apart from the inlet manifold in a direction transverse to the supply air flow; a plurality of relatively large diameter, generally L-shaped inlet tubes positioned upstream of the inlet and outlet manifolds and having discharge portions connected to the inlet manifold; and a series of relatively small diameter flow transfer tubes each connected at its opposite ends to the inlet and outlet manifolds, the small diameter flow transfer tubes being serpentined in the direction of supply air flow externally across the heat exchanger.

During operation of the furnace in which the heat exchanger of the present invention is operatively installed, a draft inducer fan operatively connected to the heat exchanger outlet manifold draws burner flames sequentially through the larger diameter inlet tubes, the inlet manifold, the serpentined flow transfer tubes, and the outlet manifold, and then discharges the combustion products into a suitable vent stack.

The serpentined, small diameter flow transfer tubes of the heat exchanger function to create a substantial resistance to burner combustion product flow through the heat exchanger, and impart turbulence to the combustion product throughflow, to thereby improve the thermal efficiency of the heat exchanger.

According to an important feature of the present invention, the compact heat exchanger is assembled using an essentially weldless fabrication process in which the combustion tubes are swedged to the manifolds. Additionally, each of the manifolds is defined by two sections, each of which has a peripheral edge portion. At each manifold, one of these two peripheral edge sections is folded around the other peripheral edge section and crimped therewith to form a weldless, essentially air tight joint extending around the manifold. Additionally, in a preferred embodiment of the compact heat exchanger, the outlet manifold is provided with a discharge conduit portion which is swedged to a support plate portion of the heat exchanger. The inlet end of each of the primary inlet tube is also swedged to the support plate.

DETAILED DESCRIPTION

Figure 1:
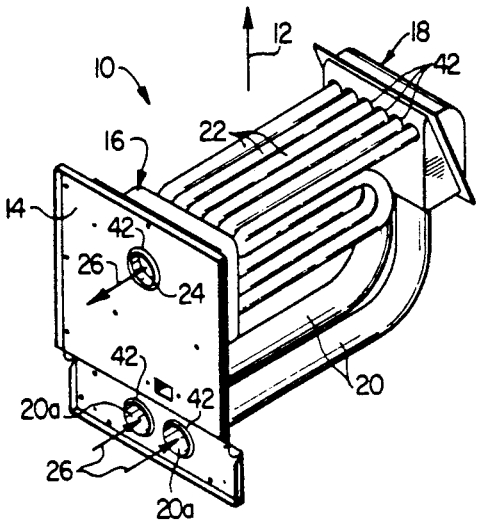
FIG. 1 is a perspective view of a compact heat exchanger, for a fuel-fired air heating furnace, which embodies principles of the present invention and is assembled using a weldless fabrication technique.
Figure 2:
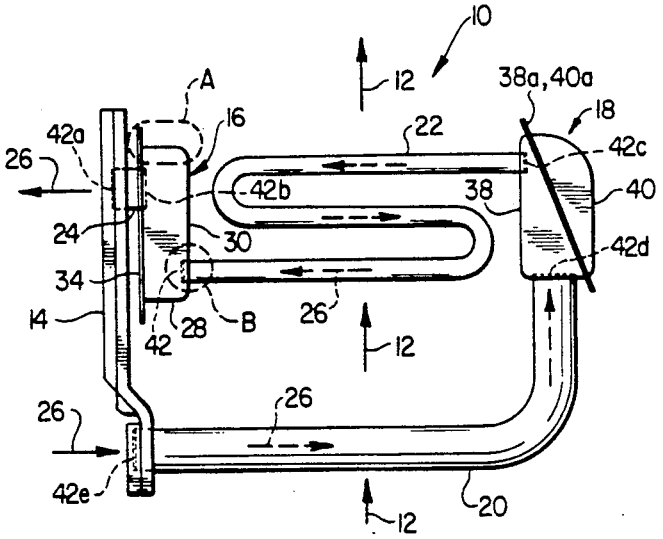
FIG. 2 is an enlarged scale right side elevational view of the heat exchanger.

Illustrated in FIGS. 1 and 2 is a compact, high efficiency heat exchanger 10 which embodies principles of the present invention and is similar in configuration and operation to the heat exchanger illustrated and described in my copending U.S. application Ser. No. 415,121 which is incorporated by reference into this application. Like its counterpart in my copending application, the heat exchanger 10 may be operatively installed in the supply plenum housing portion of an upflow, fuel-fired forced air heating furnace to heat the supply air 12 flowing upwardly through the supply plenum, exteriorly traversing the heat exchanger 10, and being delivered to a conditioned space. As subsequently described in greater detail herein, the heat exchanger 10 is assembled using an essentially weldless fabrication technique which materially reduces the overall construction costs associated with the heat exchanger.

Heat exchanger 10 includes a center or support plate structure 14, an outlet manifold 16 positioned rightwardly adjacent the support plate 14, an inlet manifold 18 spaced rightwardly and horizontally apart from the outlet manifold, a plurality of relatively large diameter, generally L-shaped primary inlet tubes 20 positioned beneath the manifolds 16 and 18 and interconnected at their opposite ends to the support plate 14 and the underside of the manifold 18, and a horizontally spaced series of vertically serpentined, relatively small diameter flow transfer tubes 22 connected at their opposite ends to the outlet manifold 16 and the inlet manifold 18.

The outlet manifold 16 has a leftwardly projecting discharge conduit 24 which is secured to the support plate structure 14 and may be connected to a draft inducer fan (not shown) associated with the furnace in which the heat exchanger 10 is operatively installed. During operation of the furnace and its associated draft inducer fan, hot burner combustion products 26 are sequentially flowed into the open inlet ends $20_a$ of tubes 20, through the tubes 20 into the inlet manifold 18, through the smaller diameter tubes 22 into the outlet manifold 16, and into the draft inducer fan, through the discharge conduit 24, for delivery to an external exhaust stack.

In a manner similar to that described in my copending U.S. application Ser. No. 415,121, now U.S. Pat. No. 4,974,579, the heat exchanger 10 has a vertically facing total peripheral surface area, and a horizontally facing total peripheral surface area which is substantially less than the vertically facing total peripheral surface area. Accordingly, the radiant heat emanating from the heat exchanger 10 toward the vertical side wall section of the furnace in which it is installed is substantially less than its radiant heat directed parallel to the flow of the supply air 12. In this manner, the available heat from the heat exchanger 10 is more efficiently apportioned to the supply air 12, thereby materially reducing outward heat loss through the furnace housing. The serpentined, small diameter flow transfer tubes 22 of the heat exchanger 10 function to create a substantial resistance to burner combustion product flow through the heat exchanger, and impart turbulence to the combustion product throughflow, to thereby improve the thermal efficiency of the heat exchanger.

Figure 3:
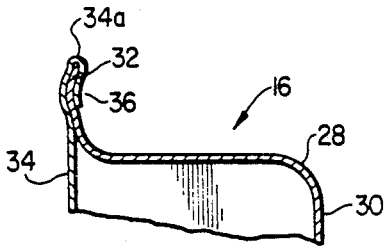
FIG. 3 is an enlarged scale partial cross-sectional view of the dashed circle area "A" in FIG. 2.

As mentioned above, the heat exchanger 10 is assembled using a weldless fabrication process which will now be described with initial reference to FIGS. 2 and 3. The outlet housing 16 has a hollow first section 28 with a rear wall 30 and an open left or front end bordered by a peripheral flange 32, and a second section defined by a plate member 34 to which the discharge conduit 24 is secured in a manner subsequently described. In constructing the outlet housing 16, a peripheral edge portion $34_a$ of the plate member 34 is folded rearwardly over the flange 32, and a crimp 36 (FIG. 3) is formed around the periphery of the housing section peripheral portions 32 and 34 to form a weldless, essentially air tight joint between the two sections of the housing 16.

The inlet housing 18 is formed from hollow front and rear sections 38 and 40 (FIG. 2) having facing peripheral edge portions that, as viewed in FIG. 2, diagonally slope downwardly and rightwardly. In a manner similar to the folding and crimping of the peripheral edge portions 32 and $34_a$ of the outlet manifold 16, one of these peripheral edge portions $38_a$, $40_a$ is folded over the other one, and a peripheral crimp is then formed in the interlocked edge portions to form a weldless, essentially air tight diagonal joint around the manifold 18.

Figure 4:
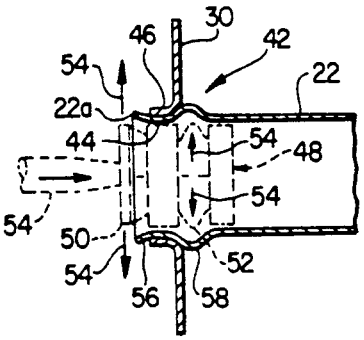
FIG. 4 is an enlarged scale partial cross-sectional view of the dashed circle area "B" in FIG. 2.

Referring now to FIG. 4, each of the outlet ends $22_a$ of the small diameter flow transfer tubes 22 is operatively secured to a lower end portion of the rear wall 30 of outlet manifold 16 by a weldless swedge joint 42. In forming each of the swedge joints 42, the tube outlet end $22_a$ is inserted inwardly through a circular opening 44 formed through the rearwall 30 and circumscribed by an inturned circular flange 46. A generally conventional cylindrical swedging tool 48, having radially expandable portions 50 and 52, is inserted into the inlet end $22_a$ of the tube 22. A tapered pin member 54 is then driven rightwardly into the hollow center of the tool 48 to radially expand its portions 50 and 52 as indicated by the arrows 54. The radially outward movement of the swedging tool portions 50, 52 correspondingly forms annular radial bulges 56 and 58 in the outlet end of tube 22, the bulge 56 being positioned inwardly of the flange 46, and the bulge 58 being formed at the outer side surface of the rear wall 30 of the outlet manifold 16. These bulges 56, 58 axially lock the tube 22 to the housing 16 and form a weldless, essentially air tight seal at the juncture between tube 22 and the manifold 16. After the swedge joint 42 is formed, the pin 54 may be removed from the swedging tool 48 to permit retraction of its portions 50, 52 and removal of the tool 48 from the tube 22.

Similar swedge joints $42_a$–$42_e$ are respectively formed between the discharge conduit 24 and the support plate structure 14; the discharge conduit 24 and the outlet housing plate member 34; the inlet ends of the tubes 22 and a top portion of the front side wall of inlet housing section 38; the tubes 20 and the bottom wall of the inlet housing section 38; and the inlet ends of the tubes 20 and the support plate structure 14. It will be appreciated that, at each of the manifolds 16 and 18, the tubing swedge joints are formed prior to the folding and crimping together of the manifold sections.

It should also be noted that the diagonal orientation of the folded and crimped joint line on inlet manifold 18 facilitates access to the interior of manifold section 38 for the swedging tool 48.

From the foregoing it can readily be seen that the heat exchanger 10 provides the configurational and operational advantages of the compact heat exchanger illustrated and described in my copending U.S application Ser. No. 415,121, while the weldless assembly technique of the present invention facilitates a substantial reduction in its overall construction cost.

The foregoing detailed description is to be clearly understood as being given by way of illustration and example only, the spirit and scope of the present invention being limited solely by the appended claims.

What is claimed is:

1. A single heat exchanger for providing essentially the entire combustion products-to-supply air heat exchange in a fuel-fired, forced air furnace having a housing portion through which supply air is forced generally parallel to a side wall section of the housing portion, said heat exchanger being assembled using an essentially weldless fabrication process and comprising:

an inlet manifold;

an outlet manifold spaced apart in a first direction from said inlet manifold and being connectable to the inlet of a draft inducer fan operative to draw hot combustion products through said heat exchanger, each of said inlet and outlet manifolds having two sections, each of the two sections having a peripheral edge portion, one of said peripheral edge portions being folded over the other of said peripheral edge portions, and crimped therewith, to form a weldless, essentially air tight joint around the manifold;

at least one relatively large diameter primary inlet tube adapted to receive hot combustion products from a source thereof and flow the received combustion products into said inlet manifold, each of said at least one primary inlet tube having a discharge portion connected to said inlet manifold and projecting outwardly therefrom in a second direction transverse to said first direction, and an inlet portion extending from an outer end portion of the discharge portion, in said first direction, toward said outlet manifold; and a series of relatively small diameter flow transfer tubes each connected at its opposite ends to said inlet manifold and said outlet manifold, said flow transfer tubes being operative to flow hot combustion products from said inlet manifold to said outlet manifold and configured to create a substantial internal flow resistance in said heat exchanger, said heat exchanger being operatively positionable within said housing portion in a manner such that said first direction of said heat exchanger extends generally transversely to said side wall section, said heat exchanger having a first total peripheral surface area facing in said second direction, and a second total peripheral surface area facing generally perpendicularly to said second direction, said first total peripheral surface area being substantially greater than said second total peripheral surface area, whereby, when said single heat exchanger is operatively installed within said housing portion, the radiant heat transferred from said single heat exchanger to supply air flowing through said housing portion is substantially greater than the radiant heat transferred from said single heat exchanger to said side wall section of the furnace, thereby materially increasing the heating efficiency rating of the furnace.

2. The heat exchanger of claim 1 wherein:

said flow transfer tubes are serpentined in said second direction.

3. The heat exchanger of claim 1 wherein:

said inlet manifold has at least one opening therein which receives a discharge end portion of said at least one primary inlet tube, and at least opening therein which receives an inlet end portion of said at least one flow transfer tube, said outlet manifold has at least one opening therein which receives a discharge end portion of said at least one flow transfer tube, and said primary inlet and flow transfer tubes are swedged to said manifolds to form weldless, essentially air tight connection joints therewith.

4. The heat exchanger of claim 1 wherein:

said weldless, essentially air tight joint around said inlet manifold is disposed within a plane extending generally diagonally relative to said first and second directions.

5. A single heat exchanger for providing essentially the entire combustion products-to-supply air heat exchange in a fuel-fired, forced air furnace having a housing portion through which supply air is forced generally parallel to a side wall section of the housing portion, said heat exchanger being assembled using an essentially weldless fabrication process and comprising:

an inlet manifold;

an outlet manifold spaced part in a first direction from said inlet manifold and being connectable to the inlet of a draft inducer fan operative to drawn hot combustion products through said heat exchanger;

at least one relatively large diameter primary inlet tube adapted to receive hot combustion products from a source thereof and flow the received combustion products into said inlet manifold, each of said at least one primary inlet tube having a discharge portion received in a corresponding opening in said inlet manifold and projecting outwardly therefrom in a second direction transverse to said first direction, and an inlet portion extending from an outer end portion of the discharge portion, in said first direction, toward said outlet manifold, each primary inlet tube being swedged to said inlet manifold to form a weldless, essentially air tight connection joint therewith; and a series of relatively small diameter flow transfer tubes each received at its opposite ends in corresponding openings in said inlet manifold and said outlet manifold, said flow transfer tubes being operative to flow hot combustion products from said inlet manifold to said outlet manifold and configured to create a substantial internal flow resistance in said heat exchanger, said flow transfer tubes being swedged to said inlet and outlet manifolds to form weldless, essentially air right connection joints therewith, said heat exchanger being operatively positionable within said housing portion in a manner such that said first direction of said heat exchanger extends generally transversely to said side wall section, said heat exchanger having a first total peripheral surface area facing in said second direction, and a second total peripheral surface area facing generally perpendicularly to said second direction, said first total peripheral surface area being substantially greater than said second total peripheral surface area, whereby, when said single heat exchanger is operatively installed within said housing portion, the radiant heat transferred from said single heat exchanger to supply air flowing through said housing portion is substantially greater than the radiant heat transferred from said single heat exchanger to said side wall section of the furnace, thereby materially increasing the heating efficiency rating of the furnace.

6. The heat exchanger of claim 5 wherein:

said flow transfer tubes are serpentined in said second direction.

7. A single heat exchanger for providing essentially the entire combustion products-to-supply air heat exchange in a fuel-fired, forced air furnace having a housing portion through which supply air is forced generally parallel to a side wall section of the housing portion, said heat exchanger comprising:

a support plate structure having first and second opposite sides;

an inlet manifold positioned on said second side of said support plate structure and spaced transversely away therefrom in a first direction;

an outlet manifold positioned adjacent said second side of said support plate structure and having an outlet conduit swedgingly connected at its opposite ends to said support plate structure and said outlet manifold, said outlet conduit being connectable to the inlet of a draft inducer fan operative to draw hot combustion products through said heat exchanger, each of said inlet and outlet manifolds having two sections, each of the two sections having a peripheral edge portion, one of said peripheral edge portions being folded over the other of said peripheral edge portions, and crimped therewith, to form a weldless, essentially air tight joint around the manifold;

at least one relatively large diameter primary inlet tube adapted to receive hot combustion products from a source thereof and flow the received combustion products into said inlet manifold, each primary inlet tube being swedgingly interconnected between said support plate structure and said inlet manifold and having a discharge portion projecting outwardly from said inlet manifold in a second direction transverse to said first direction, and an inlet portion extending from an outer end of the discharge portion, in said first direction, to said support plate structure;

a series of relatively small diameter flow transfer tubes swedgingly connected at their opposite ends to said inlet manifold and said outlet manifold, said flow transfer tubes being operative to flow hot combustion products from said inlet manifold to said outlet manifold and configured to create a substantial internal flow resistance in said heat exchanger, said heat exchanger having a first total peripheral surface area facing in said second direction, and a second total peripheral surface area facing generally perpendicularly to said second direction, said first total peripheral surface area being substantially greater than said second total peripheral surface area.

8. The heat exchanger of claim 7 wherein:

said flow transfer tubes are serpentined in said second direction.

9. The heat exchanger of claim 7 wherein:

said weldless, essentially air tight joint around said inlet manifold is disposed within a plane extending generally diagonally relative to said first and second directions.

* * * * *